US005137038A

United States Patent [19]

Kingsford

[11] Patent Number: 5,137,038

[45] Date of Patent: Aug. 11, 1992

[54] ADJUSTABLE CURVE MASCARA BRUSH

[75] Inventor: Ted Kingsford, Sarasota, Fla.

[73] Assignee: Maybe Holding Co., Wilmington, Del.

[21] Appl. No.: 634,682

[22] Filed: Dec. 27, 1990

[51] Int. Cl.[5] ..... A45D 40/26

[52] U.S. Cl. ..... 132/218; 132/317; 132/320

[58] Field of Search ..... 132/216, 217, 218, 320, 132/317; 15/172, 164

[56] References Cited

U.S. PATENT DOCUMENTS 2,244,098 6/1941 Busick ..... 15/167.1
2,254,365 9/1941 Griffith et al. ..... 15/167.1
2,429,437 10/1947 Walker ..... 15/172
4,165,755 8/1979 Cassai ..... 132/218
4,446,880 5/1984 Gueret et al. ..... 132/218

*Primary Examiner*—Gene Mancene
*Assistant Examiner*—Frank A. LaViola
*Attorney, Agent, or Firm*—Sherman and Shalloway

[57] ABSTRACT

A mascara applicator having a brush which can be adjusted by a user from straight to curved comprising a wand within which is slidably disposed an adjusting rod connecting to manipulating means within the applicator handle. The rod is extendable into an applicator head on the end of the wand and may be straight so as to straighten a precurved applicator or curved so as to impart curvature to a straight applicator.

6 Claims, 3 Drawing Sheets

ADJUSTABLE CURVE MASCARA BRUSH

BACKGROUND OF THE INVENTION

1. Field of the Invention

In the evolution and development of mascara brushes, one of the major changes has been the curved brush. That is, the typical spiral-wound brush is bent or curved in the approximate curvature of the eyelid. Such a curve is applied during the manufacture of the brush and is intended to be permanent.

While this concept has found some success in the market place, it has not been without its drawbacks. It can be awkward to use since it must be aligned with the eyelid. Such awkwardness requires a learning period and a certain degree of dexterity on the part of the user. In some cases consumers are unsure of how to use the curved brush and have used it upside down. In general, the rigid curved brush is a more difficult instrument to learn to use in the confines of the eye area, particularly the corners of the eye where a straight brush works better.

Another drawback of the pre-curved brush is that it is not readily adjustable to conform to a particular user's eyelid curvature. Even when users do attempt to adjust the brush curvature, it is virtually impossible for them to achieve a smooth curve conducive to an even application of mascara. In addition, the curvature of the upper and lower eyelids is rarely the same and a brush curved to fit the upper lid will not properly fit the lower lid.

It would therefor be advantageous to offer consumers a brush that can be curved to varying degrees or maintained straight. This would permit consumers to vary the brush configuration to their own preference and solve mascara application problems such as the difference between upper and lower lashes, the corners of the eye versus large areas, and deeply curved lids as opposed to those of only slight curvature.

Adjustable mascara brushes are known in the prior art. However, the adjustment of these brushes is in the nature of the diameter of the brush which affects the actual width of the applicator surface as in U.S. Pat. No. 3,998,235, Kingsford and U.S. Pat. No. 4,545,393, Gueret et al. It is also known to provide adjustment of the angle of the brush or applicator relative to the applicator wand or handle as in U.S. Pat. No. 4,428,388, Cassai et al., and the amount of the brush exposed as in U.S. Pat. No. 4,598,723, Cole. In no instance has there been proposed a mascara brush having an adjustable curvature.

SUMMARY OF THE INVENTION

The present invention is a mascara or similar cosmetic applicator comprising a wand on one end of which is mounted a brush or similar applicator medium. Within the wand and brush are contiguous longitudinal bores providing passage for a slidably disposed, elongated and telescopically extendable and retractable rod. The brush is preferably a one piece molded unit applied to the end of the wand but may be any of a variety of applicator types such as spirally wound bristles or the like as long as the longitudinal bore is present.

The rod is adapted to be slidably extendable from the wand into the bore of the brush, and retractable therefrom, thereby affecting the brush curvature. To achieve this, the brush may be formed to be normally straight and the rod pre-formed to curve when extended into the brush, the brush having sufficient flexibility to take that curve yet memory to return to its straight configuration when the rod is retracted. Alternatively, the brush may be pre-curved and the rod straight with sufficient rigidity to straighten the brush when extended therein, the brush returning to its curved configuration when the rod is retracted.

It is therefor an object of this invention to provide a device for the application of cosmetics having an applicator curvature that is adjustable by the user.

It is a further object to provide a cosmetic applicator in the nature of a mascara brush that may be used in a straight or a curved configuration and which is readily and easily adjustable between such configurations.

It is a still further object to provide a mascara brush which is adjustable from a straight to a curved configuration, the curvature of which may be from shallow to deep depending on the degree of adjustment made by the user.

Further objects and advantages will become evident from the accompanying drawings and description.

BRIEF DESCRIPTION OF THE DRAWING FIGURES

DETAILED DESCRIPTION OF THE INVENTION

Figure 1:
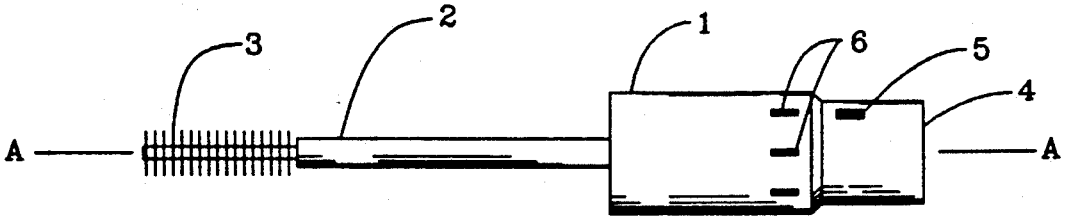
FIG. 1 is a planar view of a mascara applicator according to the present invention with the brush portion in a straight configuration.
Figure 2:
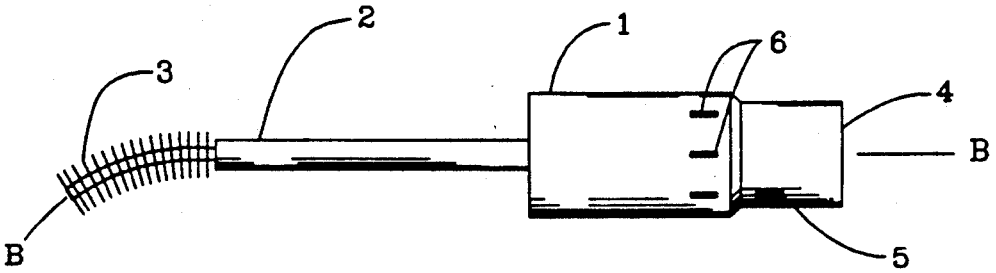
FIG. 2 is a planar view of a mascara applicator according to the present invention with the brush portion in a curved configuration.
Figure 9:
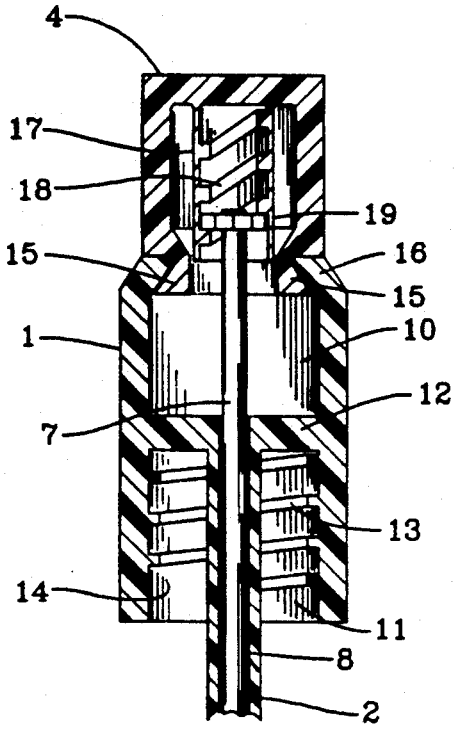
FIG. 9 is a longitudinal cross section of a mascara applicator cap illustrating one embodiment of an adjusting mechanism employed with the present invention.
Figure 10:
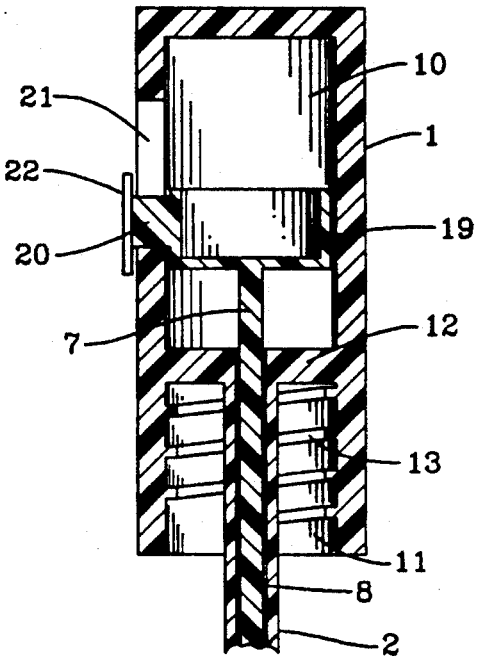
FIG. 10 is a longitudinal cross section of a mascara applicator cap illustrating an alternative embodiment of an adjusting mechanism employed with the present invention.

As shown in FIGS. 1 and 2, a mascara applicator comprises a combination cap and handle 1 from which extends a wand 2, the outer end of which carries brush 3. In the case of the present invention, cap 1 houses adjustment means as depicted in FIGS. 9 and 10 for effecting adjustment of the brush curvature. For the embodiment depicted in FIGS. 1 and 9, such adjustment is achieved by the twisting of rotatable button 4 relative to cap 1, alignment of indicia 5 on button 4 with indicia 6 on cap 1 being indicative of the degree of curvature achieved.

Figure 3:
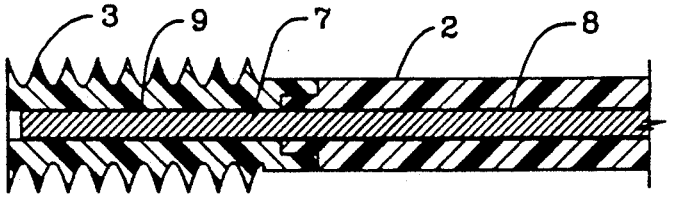
FIG. 3 is a longitudinal cross section of the brush portion of a mascara applicator taken along line A—A of FIG. 1 illustrating the straight brush configuration of one embodiment of the present invention.
Figure 4:
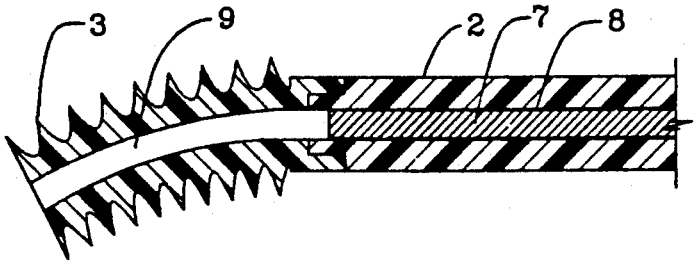
FIG. 4 is a longitudinal cross section of the brush portion of a mascara applicator taken along line B—B of FIG. 2 illustrating the curved brush configuration of the embodiment of the present invention illustrated in FIG. 3.

FIGS. 3 and 4 are partial longitudinal cross sections of one embodiment of the present invention taken along lines A—A and B—B of FIGS. 1 and 2, respectively, and illustrate the relationship of wand 2, brush 3 and curvature adjusting rod 7. Wand 2 and brush 3 have contiguous longitudinal bores 8 and 9, respectively, through their lengths. Curvature adjusting rod 7 is adapted for longitudinally slidable movement within these bores so as to be extendable into and retractable from bore 9 of brush 3.

In the embodiment of FIGS. 3 and 4, brush 3 is pre-formed to have a maximum curvature when rod 7 is retracted (see FIG. 4). In conjunction, rod 7 is formed so as to be straight when extended into bore 9 of brush 3 (FIG. 3). In this manner, complete retraction of rod 7 within wand 2 will provide a user with a deeply curved mascara application brush. To adjust the curvature of brush 3, a user will twist button 4 to extend rod 7 into bore 9 of brush 3. Rod 7 has sufficient rigidity to overcome the set-in curve of brush 3 thereby causing brush 3 to straighten. The degree of straightening, and hence curvature, of brush 3 will be dependent on the amount of rod 7 that is extended into bore 9, partial extension of rod 7 providing a shallower curve to brush 3. Because the outer end of rod 7 is not connected to anything, rod 7 is freely slidable within brush 3 and its extension and retraction will affect only the longitudinal curvature of brush 3 and not its overall diameter.

Figure 5:
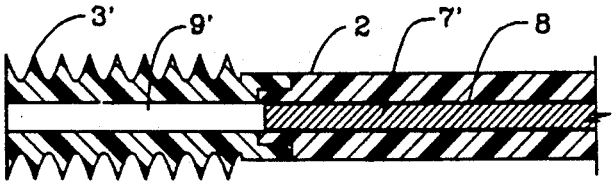
FIG. 5 is a longitudinal cross section of the brush portion of a mascara applicator taken along line A—A of FIG. 1 illustrating the straight brush configuration of an alternative embodiment of the present invention.
Figure 6:
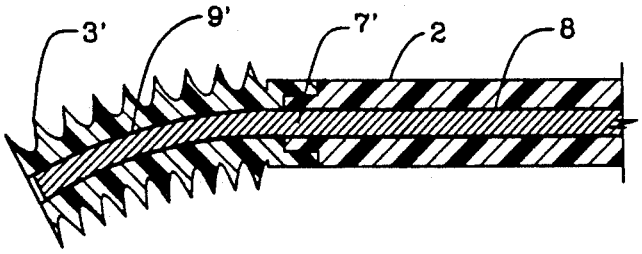
FIG. 6 is a longitudinal cross section of the brush portion of a mascara applicator taken along line B—B of FIG. 2 illustrating the curved brush configuration of the embodiment of the present invention illustrated in FIG. 5.
Figure 7:
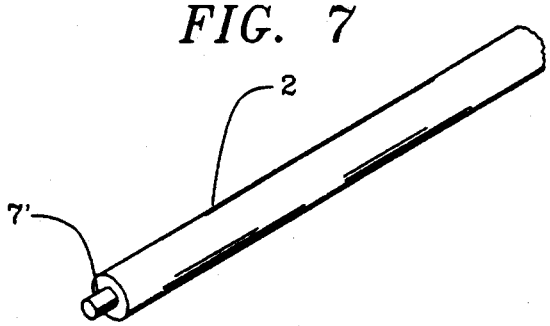
FIG. 7 is a perspective view of the wand and rod portion of the applicator of the present invention corresponding to the embodiment of FIGS. 5 and 6 and showing the adjusting rod in its retracted position.
Figure 8:
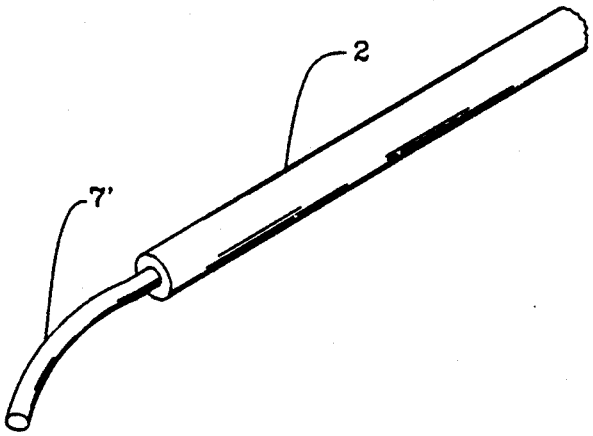
FIG. 8 is a perspective view of the wand and rod portion of the applicator of the present invention corresponding to the embodiment of FIGS. 5 and 6 and showing the adjusting rod in its extended position.

As noted above, brush 3 is pre-formed in this embodiment to be curved when rod 7 is withdrawn. In an alternative embodiment, shown in FIGS. 5 and 6, brush 3' is pre-formed to be straight and rod 7' is pre-formed to curve when extended from bore 8 of wand 2 into bore 9' of brush 3'. The relationship of rod 7' and wand 2 with rod 7' in retracted and extended positions for this embodiment is shown in FIGS. 7 and 8. In this embodiment, complete retraction of rod 7' into wand 2 provides a straight brush 3' as shown in FIG. 5, whereas full extension of rod 7' into bore 9' of brush 3' provides a deeply curved brush 3' as shown in FIG. 6. The curvature of rod 7' in this embodiment is sufficient to overcome the straightness and rigidity of brush 3'. As with the first embodiment, the degree of curvature will be dependent on the amount of rod 7' that is extended into brush 3'.

Brush 3 or 3' is depicted herein as a one piece molded unit applied to the end of wand 2. However, it is considered that brush 3 or 3' may have other forms such as a helical brush, a flat spiral spring, a bellows or the like as shown in the inventor's prior U.S. Pat. No. 3,998,235, the disclosure of which is incorporated herein by reference. A primary difference between the present invention and the inventor's prior patent is that, unlike adjusting rod 16 of the prior patent, rod 7 or 7' herein is not secured to the outer end of brush 3 or 3'. Rather rod 7, 7' is freely slidable within brush 3, 3' to effect only the variation of curvature as described above.

With regard to the nature of the adjusting rod, it may be a spirally wound cable structure tempered to be straight or curved when not confined within wand 2, depending on the embodiment followed. Alternatively, the adjusting rod may be formed of an appropriate plastic material having the required characteristics of rigidity and memory to retain either a straight or a curved configuration.

Figure 11:
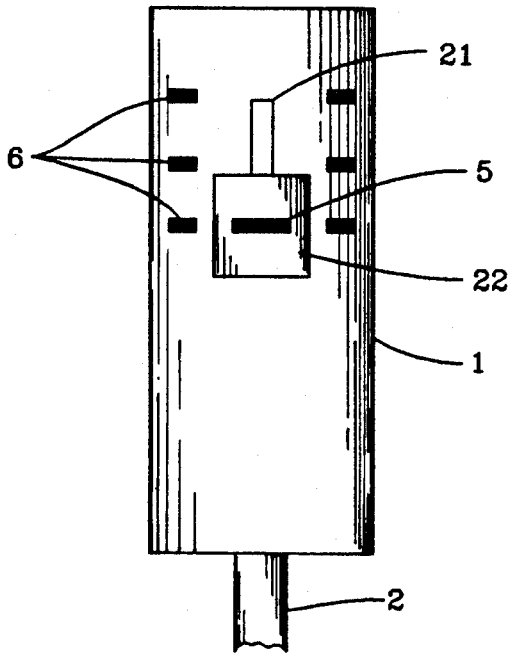
FIG. 11 is an external view of the cap of FIG. 10.

FIGS. 9, 10 and 11 illustrate adjustment means within cap 1 for use in extending and retracting the adjusting rod.

In FIG. 9, which corresponds to the form shown in FIGS. 1 and 2, cap 1 comprises an upper cavity 10 and lower cavity 11 separated by annular web 12. Lower cavity 11 is provided with threads 13 on the inner surface 14 of cap 1 for attachment of cap 1 and the associated applicator parts to a bottle containing mascara. Extending longitudinally through lower cavity 11 from web 12 beyond the confines of cap 1 and preferably molded as part of web 12 is wand 2. Bore 8 of wand 2 extends through web 12 into upper cavity 10 allowing passage of adjusting rod 7. Button 4 fits over upper cavity 10 of cap 1 and is held in place by lugs 15 that fit inside of tapered neck 16 at the upper edge of upper cavity 10. The relationship of lugs 15 with tapered neck 16 permits button 4 to be rotatably twisted relative to cap 1.

Within button 4 and depending therefrom towards upper cavity 10 is a cylindrical skirt 17, the inner surface of which is provided with threads 18 adapted to cooperate with head 19 of rod 7. Head 19 is preferably of a shape relative to skirt 17 to be able to freely rotate and travel longitudinally therein such that threads 18 acting upon head 19 when button 4 is twisted will effect extension and retraction of rod 7. In conjunction with this means of adjustment, rod 7 and bore 8 should be other than round in cross section, any out of round shape sufficient to prevent relative rotation of rod 7 within bore 8 being suitable. Possible shapes include rectangular, oval, square and the like.

An alternative sliding adjustment means is shown in FIGS. 10 and 11 wherein cap 1 is divided into upper and lower cavities 10 and 11 by web 12 from which wand 2 extends. Threads 13 within lower cavity 11 provide attachment to a mascara bottle. Rod 7 extends through bore 8 of wand 2 through web 12 into upper cavity 10. The upper end of rod 7 is provided with head 19 having a diameter and shape substantially that of the inside of upper cavity 10. Extending laterally from head 19 is lug 20 which passes through slot 21 in cap 1. The outer end of lug 20 bears actuator 22 whereby a user may effect extension and retraction of rod 7 by longitudinal movement of actuator 22 which causes head 19 to move longitudinally within upper cavity 10 thereby moving rod 7 longitudinally within bore 8 of wand 2. Indicia 5 on actuator 22 and indicia 6 on cap 1 correspond to indicia 5 and 6 of FIGS. 1 and 2 and provide the same indication of extension and retraction of rod 7 and thereby the curvature of brush 3. Naturally, other means for effecting longitudinal movement of rod 7 will be readily apparent to the practitioner. For example, a multiple position push button mechanism may be provided in cooperative engagement with rod 7. Or, rod 7 may extend beyond an opening in button 4 with either a friction fit or series of detents and a lug which may be provided, for example, in place of the threads 18 in cylindrical skirt 17. Other mechanisms, such as used in mechanical pencils, for example, can be adopted for the invention applicator.

While several embodiments have been shown to illustrate the invention, it will be understood by those skilled in the art that various changes and modifications can be made without departing from the scope of the invention.

What is claimed is:

1. An eyelash cosmetic applicator comprising:

an elongated wand having first and second ends, handle means attached to the first end of said wand, an applicator head having a longitudinal axis aligned with the longitudinal axis of said wand and attached to the second end of said wand, and means for adjusting the curvature of said longitudinal axis of said applicator head, whereby said applicator head is shaped to conform to a user's eyelid, wherein said wand has a longitudinal bore therethrough, said applicator head comprises an elongated structure having a plurality of coating surfaces axially spaced there along and having a longitudinal bore therethrough, said bores being aligned along the common longitudinal axis of said wand and said applicator head, and wherein said means for adjusting the curvature of said longitudinal axis of said applicator head changes the curvature of said applicator head in only one plane and, wherein said means for adjusting the curvature of the longitudinal axis of said applicator head comprises an elongated rod slidably disposed within said bore of said wand and telescopically extendable into and retractable from said bore of said applicator head, said rod being pre-formed to have a longitudinal curvature when extended from said wand.

2. An applicator as in claim 1, wherein said handle contains means for manipulating said rod.

3. An eyelash cosmetic applicator comprising:

an elongated wand having first and second ends, handle means attached to the first end of said wand, an applicator head having a longitudinal axis aligned with the longitudinal axis of said wand and attached to the second end of said wand, and means for adjusting the curvature of said longitudinal axis of said applicator head, whereby said applicator head is shaped to conform to a user's eyelid, wherein said wand has a longitudinal bore therethrough, said applicator head comprises an elongated structure having a plurality of coating surfaces axially spaced there along and having a longitudinal bore therethrough and is pre-formed with a longitudinal curvature, said bores being aligned along the common longitudinal axis of said wand and said applicator head, and wherein said means for adjusting the curvature of said longitudinal axis of said applicator head changes the curvature of said longitudinal axis in only one plane and, wherein said means for adjusting the curvature of said applicator head comprises an elongated rod slidably disposed with the core of said wand and telescopically extendable into and retractable from said bore of said applicator head, said rod being of sufficient rigidity to overcome the curvature of said applicator head when extended thereinto.

4. An applicator as in claim 3, wherein said handle contains means for manipulating said rod.

5. An eyelash cosmetic applicator comprising:

an elongate wand having first and second ends and a longitudinal bore therethrough, an elongate applicator head comprising a plurality of axially spaced coating surfaces and having a longitudinal bore therethrough and attached to said first end of said wand such that said bores are in longitudinal alignment and continuous, means slidably disposed within said bore of said wand and telescopically extendable into and retractable from said bore of said applicator head comprising an elongated rod extendable into and out of the longitudinal bore in said head to thereby vary the curvature of the longitudinal axis of said applicator head while the diameter of said head remains the same, and handle means attached to said second end of said wand and to said rod to manually extend and retract said elongated rod, wherein said applicator head is pre-formed to have a longitudinal curvature corresponding to the curvature of an eyelid and said rod has sufficient rigidity to overcome said curvature when extended into said bore of said applicator head, said head having memory to return to its curved configuration when said rod is retracted.

6. An eyelash cosmetic applicator comprising:

an elongate wand having first and second ends and a longitudinal bore therethrough, an elongate applicator head comprising a plurality of axially spaced coating surfaces and having a longitudinal bore therethrough and attached to said first end of said wand such that said bores are in longitudinal alignment and continuous, means slidably disposed within said bore of said wand and telescopically extendable into and retractable from said bore of said applicator head comprising an elongated rod extendable into and out of the longitudinal bore in said head to thereby vary the curvature of the longitudinal axis of said applicator head while the diameter of said head remains the same, and handle means attached to said second end of said wand and to said rod to manually extend and retract said elongated rod, wherein said applicator head is pre-formed to be longitudinally straight and said rod is preformed to be longitudinally curved when extended from said wand, the curve of said rod having sufficient tension to temporarily deform and curve said applicator head when extended thereinto, said applicator head having memory to return to a longitudinally straight configuration when said rod is retracted.

* * * * *